US005290123A

United States Patent [19]

Barnes et al.

[11] Patent Number: 5,290,123

[45] Date of Patent: Mar. 1, 1994

[54] METHOD FOR PROCESSING AND APPLYING PAVEMENT MATERIAL

[76] Inventors: James L. Barnes, 727 S. Orange Grove Blvd., Apt. 7, Pasadena, Calif. 91105; Dennis S. Barnes, 1867 W. Gordon Creek Rd., Price, Utah 84501

[21] Appl. No.: 988,294

[22] Filed: Dec. 8, 1992

Related U.S. Application Data

[63] Continuation-in-part of Ser. No. 690,746, Apr. 24, 1991, Pat. No. 5,169,261.

[51] Int. Cl.[5] ..... E01C 7/20

[52] U.S. Cl. ..... 404/75; 106/283

[58] Field of Search ..... 404/17, 67, 69, 71, 404/72, 75; 106/273.1, 276, 281.1, 283

[56] References Cited

U.S. PATENT DOCUMENTS

| | | | |
|---|---|---|---|
| 131,690 | 9/1872 | Lea . | |
| 2,068,164 | 1/1937 | Cadwell . | |
| 2,876,686 | 3/1959 | Birney . | |
| 3,074,807 | 1/1963 | Dorius . | |
| 3,110,605 | 11/1963 | Bichard . | |
| 3,206,174 | 9/1965 | Young . | |
| 3,366,500 | 1/1968 | Kracauer . | |
| 3,423,222 | 1/1969 | McConnaughay . | |
| 3,819,291 | 6/1974 | McConnaughay | 404/75 |
| 3,868,263 | 2/1975 | McConnaughay . | |
| 3,923,537 | 12/1975 | Wood . | |
| 4,100,059 | 7/1978 | Jinno . | |
| 4,227,933 | 10/1980 | McAllister, Jr. . | |
| 4,256,506 | 3/1981 | Mendenhall . | |
| 4,373,961 | 2/1983 | Stone . | |
| 4,859,502 | 8/1989 | Astrope et al. . | |
| 4,964,752 | 10/1990 | Astrope et al. | 404/111 X |

*Primary Examiner*—Ramon S. Britts
*Assistant Examiner*—Roger J. Schoeppel
*Attorney, Agent, or Firm*—Nilsson, Wurst and Green

[57] ABSTRACT

A bituminous sandstone material, which can be applied to damaged pavement areas at ambient temperatures, is prepared by comminuting naturally occurring bituminous sandstone in the presence of water to form an intimate mixture of bituminous sandstone having particles which pass through a one-quarter inch minus screen, preferably through a one-eighth inch minus screen, with sufficient water to form a material having a water content of from about 3% to about 20%, based on the weight of the mixture. In a preferred embodiment, the naturally occurring material is solidified into discrete bodies for transportation and/or storage. The discrete bodies can later be comminuted in the presence of water to form the prescribed mixture.

11 Claims, No Drawings

METHOD FOR PROCESSING AND APPLYING PAVEMENT MATERIAL

This application is a continuation-in-part of application Ser. No. 07/690,746 filed Apr. 24, 1991, now U.S. Pat. No. 5,169,261.

BACKGROUND OF THE INVENTION

1. Field of the Invention

This invention relates to a method for processing and applying pavement materials. In particular, it relates to the use of naturally occurring bituminous sandstone in pavement surfaces.

2. Discussion of the Prior Art

Pavement surfaces, by their very nature, are subject to continuous wear by their users, i.e., by the constant travel of pedestrians, automobiles and aircraft. Pavement surfaces are also subject to degradation because they are exposed to the elements, i.e., rain, snow and extreme temperatures. As a result, pavement surfaces are repeatedly damaged by the formation of cracks, potholes, and the like. Consequently, there is a great need for materials to repair such damage simply and inexpensively.

One method for repairing pavement surfaces is known as "hot patch" repair. Hot patch repair employs a tar-like material which is heated to approximately 400° F. and then immediately forced into or over damaged areas. A major drawback of hot patch materials and methods is that they require relatively expensive equipment to heat the tar-like material on-site. Further, the method generally requires that the damaged pavement be pretreated with a preliminary coating of a base material to provide sufficient bonding between the material and the damaged area.

Another method of repair is described in U.S. Pat. No 4,859,502 to Astrope et al., which patent is hereby incorporated by reference. The method employs mixing bituminous sandstone with heated water in a ratio of 20 to 56% water, by weight, to form a slurry having a temperature of from 110°-210° F. The temperature of the slurry is maintained within this range throughout the mixing process in order to maintain its properties. The slurry is then pumped through a conduit and applied to the area to be repaired. Among the disadvantages of the method disclosed in the Astrope et al. patent is the cost of the equipment needed to form the hot slurry and then pump the material to the damaged area.

Attempts have also been made to use bituminous sandstone in paving and repair operations which are "cold", i.e., performed without heating. In central Utah, where large deposits of bituminous sandstone exist, roads are constructed using this material in a dry state. When road damage occurs, additional bituminous sandstone is used to repair the holes, again in a dry state, without special processing or treatment. Unfortunately, the naturally occurring material is difficult to work with because it is mined in aggregate chunks which are difficult to reduce to a uniform grain size. The material is also extremely difficult to transport in the dry state because it solidifies in the course of transportation into a large mass which cannot be handled efficiently. Accordingly, untreated bituminous sandstone material is not useful in most paving operations.

SUMMARY OF THE INVENTION

According to the process of the present invention, naturally occurring bituminous sandstone can be mixed with water, either at a processing plant or "on-site" at the location of a paving operation. In either case, the sandstone is comminuted in the presence of water to form an intimate mixture of bituminous sandstone having particles which pass through a one-quarter inch minus screen, preferably through a one-eighth inch minus screen, with sufficient water to form a material having a water content of from about 3% to about 20%, preferably from about 10% to about 18%, based on the weight of the mixture. In some embodiments, the mixture additionally contains an aggregate, such as recycled asphalt pavement.

Damaged pavement is repaired simply by applying the resulting mixture at ambient temperatures, either locally or over an entire pavement surface. Once the mixture has set, it forms a strong and effective composition which is impervious to water and has both good adhesion and ductility.

When it is required to form the prescribed water-wet mixture at a location remote from where bituminous sandstone is mined, whether due to logistics or to the size of a particular paving job, the bituminous sandstone can be transported to the remote location as a plurality of discrete bodies of solidified material. Solidification of a load of sandstone into a single mass which cannot be easily handled is avoided in this way. Discrete bodies of manageable size can be formed by physically compressing the sandstone or by simply allowing it to solidify naturally in small quantities.

DETAILED DESCRIPTION OF THE PREFERRED EMBODIMENT

Bituminous sandstones are naturally occurring materials which contain sandstone particles impregnated with and bound together by varying amounts of bitumen. Any naturally occurring bituminous sandstone material can be used in accordance with the invention. A preferred material is found in the Asphalt Ridge area of Unitah County, Utah. Representative Asphalt Ridge material contains from about 8% to about 12% bitumen, where the bitumen comprises 19% asphaltenes, 45% resins, 32% cyclic oils and 4% naphthenes.

The bituminous sandstone is comminuted in the presence of water at ambient temperature using conventional grinding machines. A preferred grinding machine is a hammermill, although a roller mill, a ball mill, a cone mill or any other suitable device may be used. The resulting bituminous sandstone has particles which pass through a one-quarter inch minus screen, preferably a one-eighth inch minus screen, and a water content of from about 3% to about 20%, preferably from about 10% to about 18%, based on the weight of the mixture.

Particle sizes greater than those which can pass through a one-quarter inch minus screen are not desirable in many applications because the resulting material is too coarse to enter certain damaged areas, such as cracks. Particle sizes less than those of the sandstone particles contained in the bituminous sandstone are not desirable because of the practical difficulties in obtaining such sizes.

A water content above about 20% is normally not desirable because the excess water increases handling costs and increases the time it takes the material to set after its application. Water contents below about 3% are not desired because they do not provide sufficient water to prevent the material from prematurely setting.

In some embodiments, particularly those in which the material is to be applied to areas greater than about one inch across, such as pot holes, the material is admixed with an aggregate. Sand is a preferred aggregate. It is an advantage of the product and process in accordance with the invention that recycled asphalt pavement also can be used as the aggregate.

The aggregate can be added to the bituminous sandstone material after it has been ground in the presence of water. Alternatively, the bituminous sandstone can be admixed with the aggregate and heated to a temperature sufficient to soften the bitumen prior to the addition of water according to the preferred embodiments of the invention. Representative apparatuses for admixing bituminous sandstone with hot aggregate include mixers and recyclers used in conventional hot mix processes.

In the course of this alternative process, the bituminous sandstone and the hot aggregate are mixed for a time sufficient to separate the sandstone particles from one another. Typical temperatures are from about 200° F. to about 450° F. The resulting composite is then cooled and water is added at ambient temperature to create the final product, which itself is maintained at ambient temperature, and has a water content of from about 3% to about 20%, preferably from about 10% to about is%, based on the weight of all the components. The aggregate-containing mixture can then be applied directly to a damaged pavement surface.

The mixture may also contain conventional setting inhibitors, such as solvents, or conventional freezing inhibitors.

In one embodiment, the material is ultimately packaged in a vapor-proof container to maintain the water content of the mixture. Illustrative containers include metal cans, plastic cans and plastic bags. Once sealed in a vapor-proof container, the material remains stable throughout storage and transportation to the damaged site. The material remains in a plastic or workable condition until the container is opened just prior to repair.

In another embodiment, the material is applied directly to damaged pavement or a graded, unpaved surface to fill any imperfections and form a uniform surface layer. This normally occurs when the bituminous sandstone is mixed with water at or near the paving job site.

When a job site is located far from where bituminous sandstone is mined, it is desirable to transport the bituminous sandstone in its natural state and not mix it with water until it reaches its destination. However, it is not feasible to transport the naturally occurring material to the job site in bulk. If one were to attempt to do so, the material would solidify into a single rigid mass which would be difficult or impossible to use. Therefore, according to a further embodiment of the invention, naturally occurring bituminous sandstone is preferably formed into discrete bodies of solidified material, and subsequently milled and mixed with water at or near its ultimate destination to produce the required water-wet mixture.

When naturally occurring bituminous sandstone is formed into discrete bodies of this type, the bodies can be stacked in large quantities for transportation and storage. They do not bond to each other in the manner of bulk bituminous materials.

Solidification of bituminous sandstone into discrete bodies can be achieved either by allowing the material to settle naturally or by applying pressure to form the sandstone into "pellets" of preselected size or weight. The pressure used to form the pellets is preferably between about 10 and about 50 pounds per square inch (psi), and most preferably about 15 psi, which can be achieved with conventional hydraulic ram mechanisms. The pellets can be made of any suitable size, but are preferably approximately 50 pounds.

The material can be used to repair any pavement surface, including both asphalt and cement surfaces. The damaged area is first cleaned of sand and other loose debris, preferably by hosing with water. The material is then applied, at ambient temperatures, by tamping or forcing the material into any damaged areas and spreading it over any larger areas to be covered. The process is advantageous because the material need not be heated and a preliminary coat of base material is not required.

In some embodiments, additional water is added to the mixture so that it has the consistency of wet sand. A squeegee or cement float is then used to smooth the surface of the repaired area.

Setting typically takes from about six to about twenty-four hours, depending on weather conditions and depth of the treated area. Once the material has set, it forms a strong and effective repair having both good adhesion and ductility.

What is claimed is:

1. A method for processing naturally-occurring bituminous sandstone for use as a pavement material, comprising:

forming naturally occurring bituminous sandstone into a plurality of discrete bodies of solidified material;

subsequently milling said bodies to form particles which pass through a one-quarter inch minus screen and mixing said particles with sufficient water to form a water content of from about 3% to about 20%, based on the weight of the mixture, where said mixture is formed at ambient temperature.

2. The method of claim 1 which further comprises:

applying the mixture to a pavement surface; and allowing the mixture to set.

3. The method of claim 1 wherein:

said discrete bodies are formed by compressing said bituminous sandstone.

4. The method of claim 1 wherein:

said discrete bodies are formed by allowing said bituminous sandstone to solidify naturally in preselected quantities.

5. A method in accordance with claim 1, wherein the bituminous sandstone has particles which pass through a one-eighth inch minus screen and a water content of from about 10% to about 18%, based on the weight of the mixture.

6. A method in accordance with claim 1, wherein the intimate mixture further comprises an aggregate.

7. A method in accordance with claim 5, wherein the intimate mixture further comprises an aggregate.

8. A method in accordance with claim 6, wherein the aggregate is sand aggregate or recycled asphalt aggregate.

9. A method in accordance with claim 7, wherein the aggregate is sand aggregate or recycled asphalt aggregate.

10. A method in accordance with claim 8, wherein the aggregate is recycled asphalt aggregate.

11. A method in accordance with claim 9, wherein the aggregate is recycled asphalt aggregate.

* * * * *